US005715783A

United States Patent [19]

Osakabe et al.

[11] Patent Number: 5,715,783

[45] Date of Patent: Feb. 10, 1998

[54] RECOIL STARTER

[75] Inventors: Mitsuo Osakabe, Gunma-gun; Keizo Shimizu, Annaka; Seiichi Nieda, Takasaki, all of Japan

[73] Assignee: Starting Industrial Co., Ltd., Tokyo, Japan

[21] Appl. No.: 784,761

[22] Filed: Jan. 16, 1997

[30] Foreign Application Priority Data

Apr. 30, 1996 [JP] Japan ..... 8-132598
Oct. 16, 1996 [JP] Japan ..... 8-294347

[51] Int. Cl.[6] ..... F02N 3/02

[52] U.S. Cl. ..... 123/185.3; 74/7 C; 192/42

[58] Field of Search ..... 123/185.2, 185.3, 123/185.4; 74/7 C; 192/42

[56] References Cited

U.S. PATENT DOCUMENTS 2,709,994 6/1955 Chandler ..... 123/185.3
5,014,657 5/1991 Tsunakawa et al. ..... 123/185.3

*Primary Examiner*—Andrew M. Dolinar
*Attorney, Agent, or Firm*—Laurence R. Brown

[57] ABSTRACT

There is provided a recoil starter for starting an internal combustion engine which has a simple and compact structure with a reduced number of parts and which can be manufactured at a reduced cost. In a recoil starter wherein a shaft portion 2' having a reel 3' rotatably attached thereto is provided on a starter case 1 and wherein a rope 4 wound around the reel 3' by a restoring force of a spring 5 is drawn out to rotate the reel 3' thereby driving a pulley 31 to start an internal combustion engine, a configuration is employed wherein a frictional resistance means is provided on the shaft portion 2'; one end of an arm 28 assembled with frictional resistance against the rotation of the reel 3' is anchored or press-fitted to the friction resistance means with another end thereof engaged with a guide groove 27 on the reel 3'; and the rotation of the reel 3' causes the other end of the arm 28 to move in the guide groove 27 for a swinging motion which causes the arm 28 to be engaged with a notch 32 on the pulley 31. This allows the number of parts to be reduced to achieve a reduced overall size and allows manufacturing cost to be reduced.

7 Claims, 5 Drawing Sheets

PRIOR ART

RECOIL STARTER

BACKGROUND OF THE INVENTION

1. Field of the Invention

The present invention relates to a recoil starter used for starting an internal combustion engine.

2. Description of the Related Art

FIG. 8 is a sectional view showing a configuration of a conventional recoil starter wherein a shaft portion 2 is secured to the position of a core of a starter case 1; a reel 3 is rotatably attached to the shaft portion 2; and a rope 4 is wound around a recess 3*a* formed on the periphery of the reel 3 utilizing a restoring force of a spring 5.

A ratchet 6 is attached to the reel 3, and a pin 8 is secured to an intermediate position on the ratchet 6. The ratchet 6 is attached to the reel 3 so that it is located to be movable between an inclined surface and a protruding surface formed in the vicinity of the periphery of the reel 3. A friction plate 9 is attached to the shaft portion 2. The friction plate 9 is formed with a guide portion for guiding the pin 8 to cause the ratchet 6 to protrude and retract in a radial direction.

Provided on the engine is a pulley 13 which is connected to the crank shaft and which is formed with a recess at an outer end thereof.

A peripheral portion of the starter case 1 is secured to a fan cover with bolts and nuts.

In the conventional recoil starter having the above-described configuration, when the rope 4 is drawn out against the restoring force of the spring 5 in a stalled state, the friction plate 9 is maintained in a stalled state by friction with the shaft portion 2, and the reel 3 and the ratchet 6 rotate. As a result, the pin 8 of the ratchet 6 protrudes outwardly under the guidance of the guide portion of the friction plate 9 into engagement with the recess on the pulley 3 and rotates to start the engine.

When the rope 4 is released after the engine is started, the restoring force of the spring 5 causes the reel 3 to rotate in the opposite direction, which rewinds the rope 4 and retracts the ratchet 6 to the initial position.

The above-described conventional recoil starter must have a configuration wherein the ratchet 6 is attached to the reel 3; the pin 8 is secured roan intermediate portion of the ratchet 6; and the ratchet 6 is disposed so that it is movable between the inclined surface and protruding surface formed in the vicinity of the periphery of the reel 3. This has resulted in an increase in the number of parts and a complicated structure which have been unfavorable also from the viewpoint of manufacturing cost.

SUMMARY OF THE INVENTION

The present invention has been conceived considering the current situation of recoil starters as described above, and it is an object of the present invention to provide a recoil starter which has a simple and compact structure with a reduced number of parts and which therefore allows a reduction in manufacturing cost.

In order to achieve the above-described object, according to the present invention, there is provided a recoil starter wherein a reel is rotatably attached to a shaft portion provided on a starter case attached to a fan cover and wherein the reel is rotated by drawing out a rope wound around the reel utilizing a restoring force of a spring to drive a pulley secured to a crank shaft thereby starting an internal combustion engine, characterized in that it comprises a frictional resistance means provided on the shaft portion and an arm means for producing frictional resistance against the rotation of the reel between the frictional resistance means and the shaft portion, fitted in a guide means formed on the reel at one end thereof and in that the one end of the arm means is guided by the rotation of the reel to be swung into engagement with the pulley.

The present invention is further characterized in that the frictional resistance means for producing frictional resistance at the arm means comprises a guide or washer and in that the guide means for guiding one end of the arm means to swing the same comprises a groove.

In this case, a pair of protrusions are preferably provided on the side of the reel facing the pulley for supporting the arm means such that they sandwich the arm means when it is engaged with the pullet at the engaged portion. Alternatively, at least one notch is preferably formed on the periphery of the pulley; the notch is a combination of a rectangle and a right triangle; and the rectangle is positioned so as to precede in the rotating direction of the pulley.

As described above, the present invention employs a configuration wherein a friction resistance means is formed by anchoring one end of an arm means to a guide or washer attached around a core of a shaft portion provided on a starter case or by forcing one end of the arm means into the shaft portion provided on the starter case to produce frictional resistance against the rotation of the reel between the frictional resistance means and the shaft portion; a guide groove is formed on the reel as a guide means into which another end of said arm is fitted and which guides the other end of the arm as the reel rotates to cause it swing into engagement with the pulley; and the engagement between the arm and the pulley transmits the rotation of the reel to the pulley through the arm. It is preferable to provide a pair of protrusions on the side of the reel facing the pulley for supporting the arm such that they sandwich the arm when it is engaged with the pulley at the engaged portion because this maintains the strength of the arm by preventing deflection of the same to prevent breakage and the like. Meanwhile, at least one notch is provided on the periphery of the pulley; the notch is a combination of a rectangle and a right triangle; and the rectangle is positioned so as to precede in the rotating direction of the pulley. Thus, when the rope is released after the engine is started to allow the reel to be rotated by the restoring force of the spring, the arm fitted into the guide groove slides out of the rectangular portion and on the bottom of the right triangular portion. This allows the arm to be released from the pulley with no shock, thereby improving the durability of the arm.

DETAILED DESCRIPTION OF PREFERRED EMBODIMENTS

An embodiment of the present invention will now be described with reference to FIGS. 1 through 5.

Figure 1:
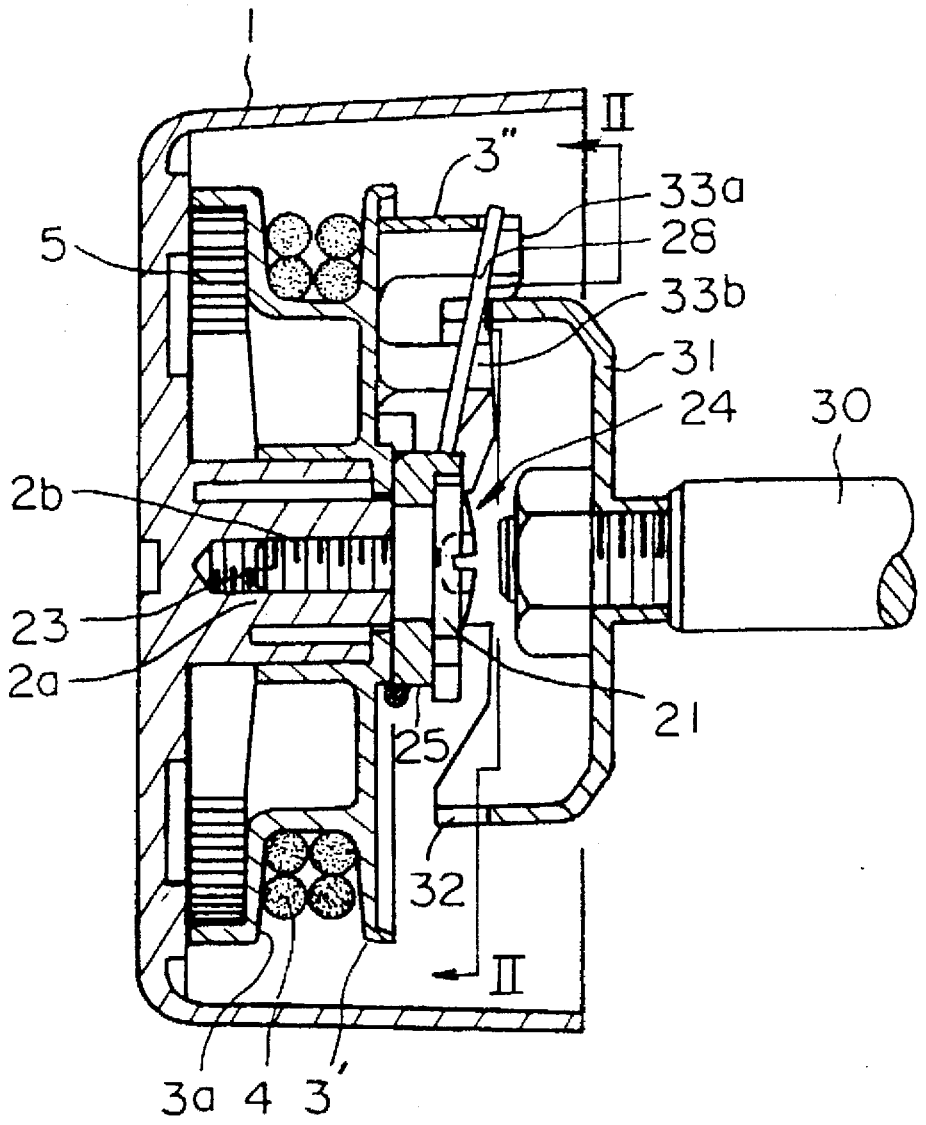
FIG. 1 is a sectional view showing a configuration of an embodiment of the present invention.

According to the present invention, a starter case 1 is formed of resin and, as shown in FIG. 1, a boss portion 2*a* is formed in the middle of a shaft portion 2' of the starter case 1. The boss portion 2*a* has a threaded hole 2*b* into which a screw element 24 is screwed. With this screw element 24, a guide 25 is attached to a protruding end of the shaft portion 2' around a core of the shaft. An arm 28 made of metal or resin assembled and disposed in the starter case 1 is wound halfway around the guide 25 at a portion near one end 28*a* thereof which is anchored to the guide 25, thereby forming a frictional resistance means.

Figure 2:
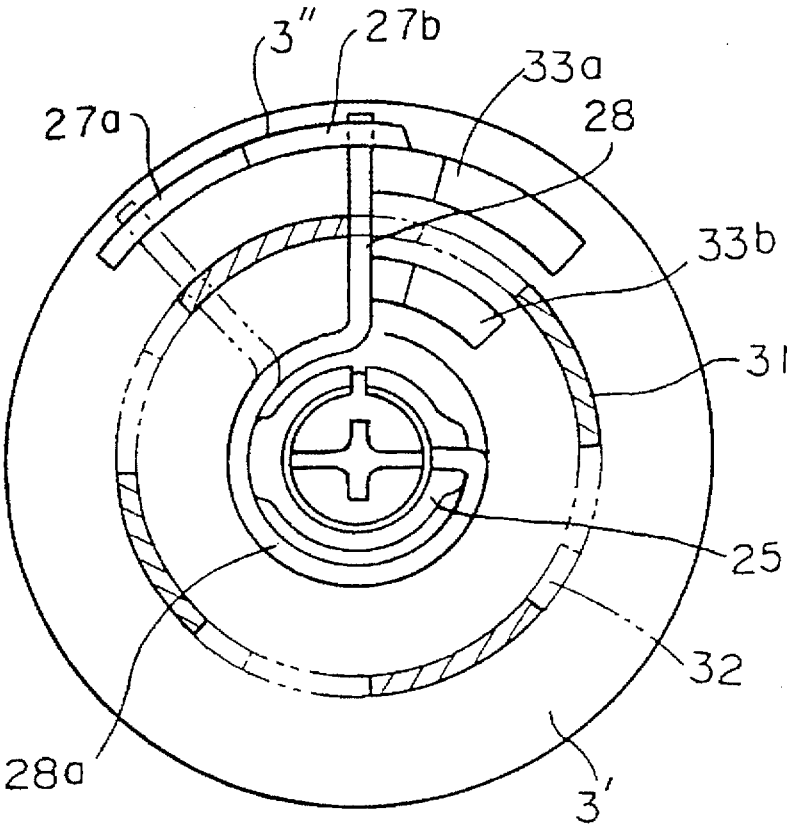
FIG. 2 is a sectional view taken along the line II—II in FIG. 1.
Figure 3:
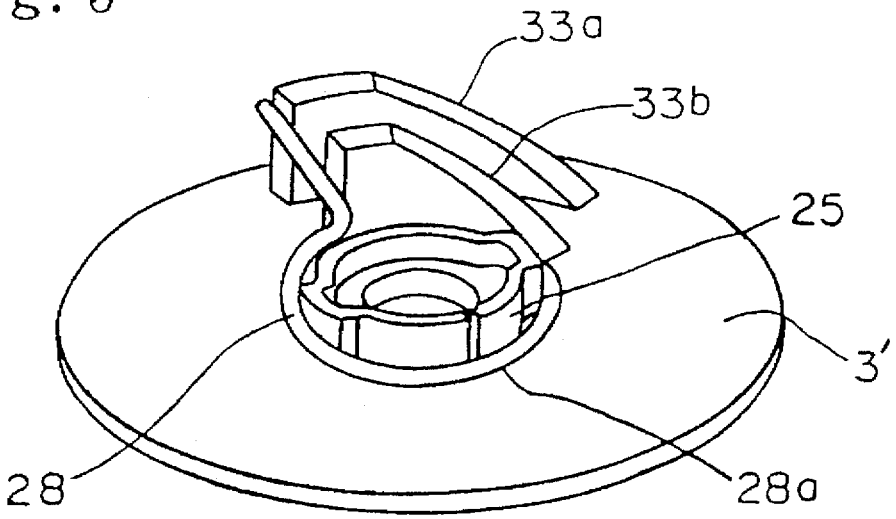
FIG. 3 is a perspective view of the reel portion with the protruding wall removed.
Figure 4:
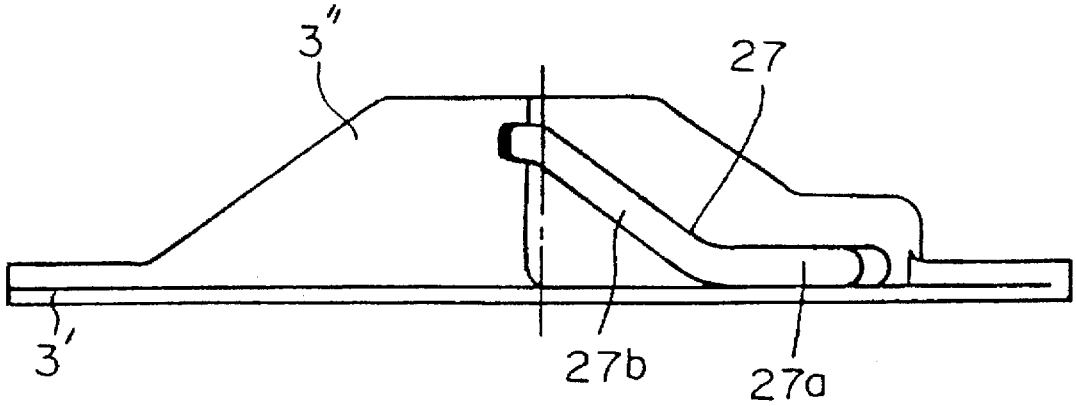
FIG. 4 illustrates a configuration of the guide groove portion in FIG. 1.
Figure 5:
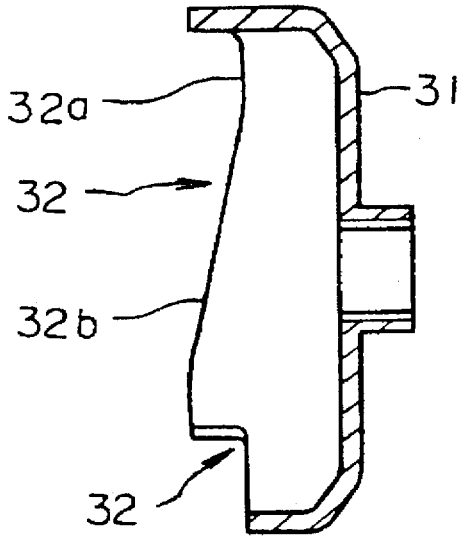
FIG. 5 is a central longitudinal section of a pulley secured to a crank shaft.

A reel 3' made of resin is rotatably attached to the shaft portion 2', and the periphery of the reel 3' is formed with a recess 3*a* around which a rope 4 is wound. Further, the reel 3' is formed with a protruding wall 3" which protrudes in the axial direction of the reel 3' in parallel with the shaft portion 2' and extends in the circumferential direction thereof. As shown in FIGS. 2 and 5, this protruding wall 3" is formed with a guide groove 27 into which another end of the arm 28 is fitted.

The guide groove 27 formed in the protruding wall 3" is comprised of a horizontal groove 27*a* in parallel with the surface of the reel 3' and an inclined groove 27*b* which is formed continuously with one end of the horizontal groove 27*a* and is inclined away from the surface of the reel 3'. The horizontal groove 27*a* is provided so as to precede in the rotating direction of the reel 3' when the rope 4 is drawn out.

A pulley 31 secured to a crank shaft 30 is disposed so that the end face thereof is close to one side of the reel 3. The pulley 31 is formed with at least one notch 32 which is a combination of a rectangular portion 32*a* and a right-triangular portion 32*b* and is configured so that the rectangular portion 32*a* is positioned to precede in the rotating direction of the pulley 31. A pair of protrusions 33*a* and 33*b* are provided on the side of the reel 3' facing the pulley 31 to support the arm 28 such that they sandwich the arm 28 when it is guided by the guide groove 27 to swing into engagement with the notch 32 on the pulley 31 at the engaged portion.

According to the present invention having such a configuration, when the rope 4 is drawn out against the restoring force of the spring 5 in a stalled state, a pulling force of the rope 4 causes the reel 3' to start rotating. However, the arm 28 is retained in the initial position by frictional resistance produced between the part of the arm 28 wound around the guide 25 and the shaft portion 2' of the starter case 1. As a result, the reel 3' rotates with the other end of the arm 28 fitted in the horizontal groove 27*a* of the guide groove 27.

Such rotation of the reel 3' causes the end of the arm 28 in engagement with the guide groove 27 to be moved from the horizontal groove 27*a* to the inclined groove 27*b* of the guide groove 27. Thus, as the reel 3' rotates, the end of the arm 28 anchored to the inclined groove 27*b* is moved away from the surface of the reel 3' toward the pulley 31 into abutment and engagement with the end of the inclined groove 27*b*. In other words, one end of the arm 28 fitted in the guide groove 27 is swung about the wound portion at the other end thereof. In this state, the arm 28 is engaged with the at least one notch 32 (a plurality of notches in the illustrated embodiment) provided on the periphery of the pulley 31. Specifically, the arm 28 first slides on the inclined surface of the right-triangular portion 32*b* of the notch 32 and then abuts the end of the rectangular portion 32*a* into engagement therewith.

When the rope 4 is pulled further, the pulling force overcomes the frictional force produced between the part of the arm 28 wound around the guide 25 and the shaft portion 2'. As a result, the rotation of the reel 3' causes the pulley 31 secured to the crank shaft to rotate starting the engine for rotation with the arm 28 anchored to the inclined groove 27*b* of the reel 3'. At this time, the arm 28 is supported by the pair of protrusions 33*a* and 33*b* provided on the side of the reel 3' facing the pulley 31 to prevent the arm 28 in engagement with the notch 32 from being deflected.

When the rope 4 is released after the engine is started, the restoring force of the spring 5 causes the reel 3' to rotate in the opposite direction, thereby rewinding the rope 4. At the same time, the frictional resistance produced between the part of the am 28 wound around the guide 25 and the shaft portion 2' causes the arm 28 which tends to retain the initial position to swing toward the reel 3' by the presence of the inclined groove 27*b*, and the arm 28 slides on the inclined surface at the bottom of the right-triangular portion 32*b* of the notch 32 on the pulley 31 to be disengaged from the notch 32 and to return to the initial position.

Figure 6:
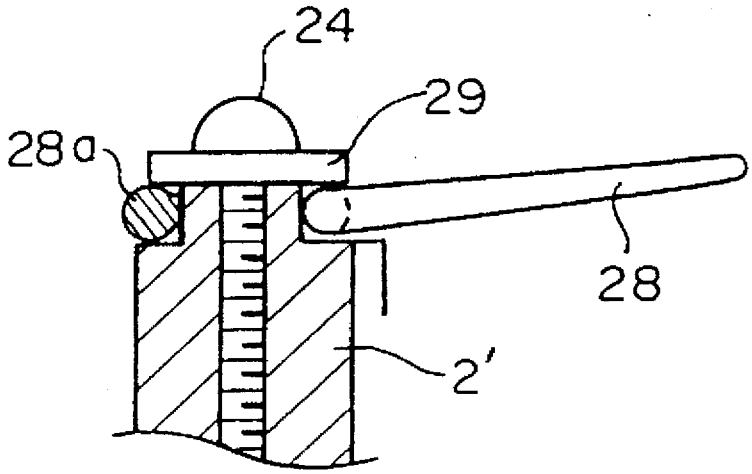
FIG. 6 is a partial enlarged sectional view of another embodiment of the frictional resistance means.
Figure 7:
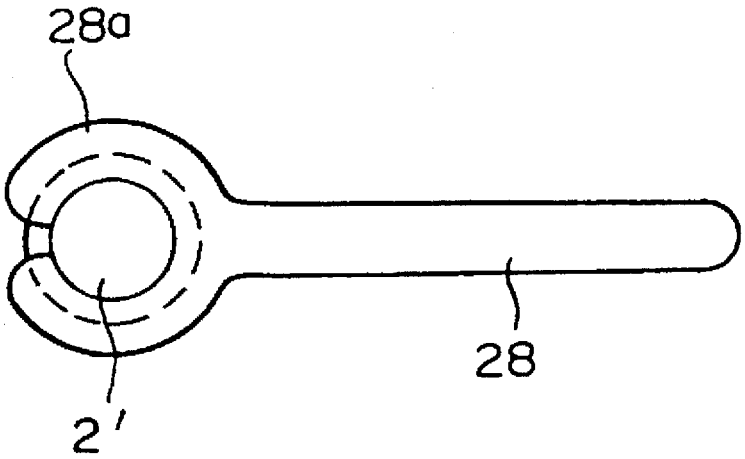
FIG. 7 is a plan view of FIG. 6.
Figure 8:
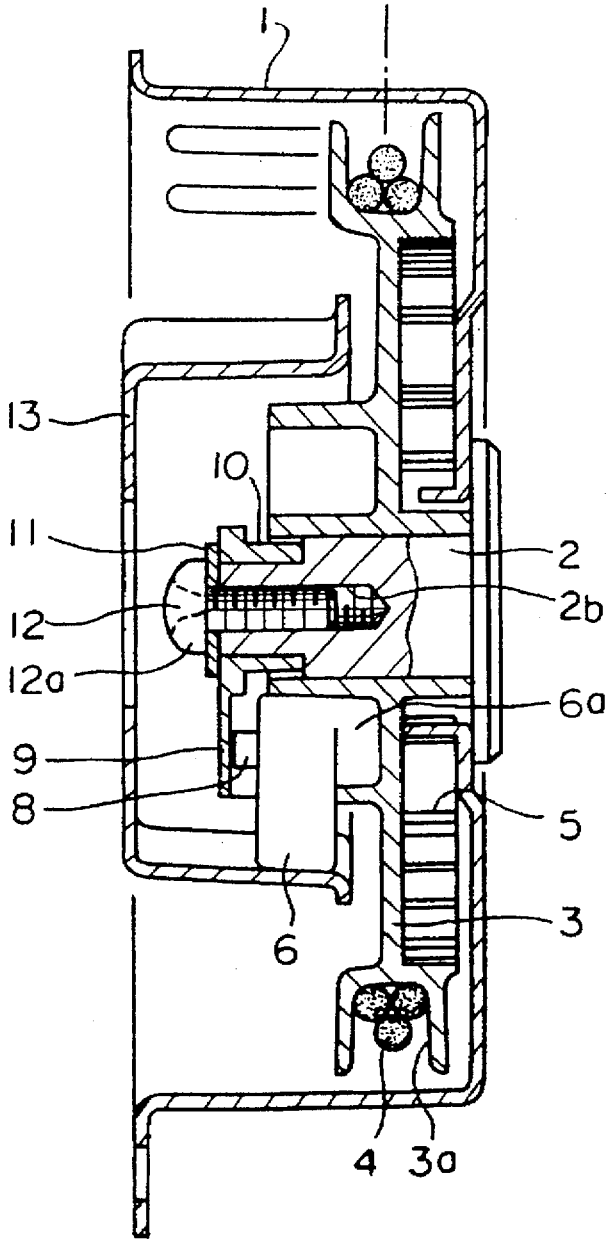
FIG. 8 is a sectional view showing a configuration of a conventional recoil starter.

In the above embodiment, the friction resistance means has been described as an arrangement wherein the arm, 28 assembled and disposed in the starter case 1 is wound halfway around the guide 25 at an area near one end 28*a* thereof. Alternatively, the friction resistance means may be configured as shown in FIGS. 6 and 7.

Specifically, in this embodiment, one end 28*a* of the arm 28 made of metal or resin as an arm means is formed in a partially cutaway circular configuration; the protruding end of the shaft portion 2' is formed to have a diameter slightly larger than that of the end 28*a* in a partially cutaway circular configuration; the end 28*a* in a partially cutaway circular configuration is press-fitted to the protruding end; and a screw element 24 is mounted through a washer 29 to configure the friction resistance means.

As described above, one end 28*a* of the arm 28 is anchored to the guide 25 attached to the protruding end of the shaft portion 2' with the screw element 24. Alternatively, one end 28*a* in a partially cutaway circular configuration of the arm 28 is press-fitted to the protruding end of the shaft portion 2'. The other end of the arm 28 is fitted into the guide groove 27 formed in the protruding wall 3" of the reel 3'. The rotation of the reel 3' causes the other end of the arm 28 to move in the guide groove 27 from the horizontal groove 27*a* to the inclined groove 27*b*, thereby swinging the arm 28. Thus, the arm 28 is engaged with the notch 32 on the pulley 31, which allows the engine to be smoothly started by the rotation of the pulley 31 caused by the rotation of the reel 3'.

Further, according to the present invention, the arm 28 is disposed so as to extend between one end 28*a* thereof anchored or press-fitted and the protruding wall 3" of the reel 3' and is constructed so that the other end thereof is engaged with the pulley 31 by means of the guide groove 27 formed on the protruding wall 3". Thus, a frictional resistance generating portion (friction portion) and a ratchet portion in a conventional recoil starter are integrated into one element, which not only reduces the number of parts and manufacturing cost but also allows the device to be made more compact as a whole.

As described above, according to the present invention, in a recoil starter wherein a shaft portion is provided on a starter case attached to a fan cover; a reel is rotatably attached to the shaft portion; and a rope wound around the reel by a restoring force of a spring is drawn out to rotate the reel thereby driving a pulley to start an internal combustion engine, a configuration is employed wherein a frictional resistance means is provided on the shaft portion, one end of an arm assembled in the starter case for producing frictional resistance against the rotation of the reel is anchored or press-fitted to the friction resistance means; another end of the arm is engaged with a guide groove formed on the reel; the rotation of the reel causes the other end of the arm to move in the guide groove for a swinging motion which causes the arm to be engaged with a pulley; and the rotation of the reel is thus transmitted to the pulley. This allows the number of parts to be reduced to achieve a reduced overall size and allows manufacturing cost to be reduced.

In addition, according to the present invention, a pair of protrusions are provided on the side of the reel facing the pulley for supporting the arm such that they sandwich the arm when it is engaged with the pulley at the engaged portion. This maintains the strength of the arm by preventing deflection of the same to prevent breakage and the like. Moreover, at least one notch is provided on the periphery of the pulley; the notch is a combination of a rectangle and a right triangle; and the rectangle is positioned so as to precede in rotating direction of the pulley. Thus, when the rope is released after the engine is started to allow the reel to be rotated by the restoring force of the spring, the arm fitted into the guide groove slides out of the rectangular portion and on the bottom of the right-triangular portion. This allows the arm to be released from the pulley with no shock, thereby improving the durability of the arm.

While particular embodiment of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A recoil starter wherein a reel is rotatably attached to a shaft portion provided on a starter case attached to a fan cover and wherein said reel is rotated by drawing out a rope wound around said reel utilizing a restoring force of a spring to drive a pulley secured to a crank shaft thereby starting an internal combustion engine, comprising:

a frictional resistance means provided on said shaft portion; and an arm means for producing frictional resistance against the rotation of said reel between said frictional resistance means and said shaft portion, fitted in a guide means formed on said reel at one end thereof, wherein:

said one end of said arm means is guided by the rotation of said reel to be swung into engagement with said pulley.

2. A recoil starter according to claim 1, wherein said frictional resistance means for producing frictional resistance at said arm means comprises a guide or washer.

3. A recoil starter according to claim 1, wherein said arm means is wound around or press-fitted to said shaft portion.

4. A recoil starter according to claim 1, wherein said guide means for guiding one end of said arm means to swing the same comprises a groove.

5. A recoil starter according to claim 1, wherein a pair of protrusions are provided on the side of said reel facing said pulley for supporting said arm means such that they sandwich said arm means when it is engaged with said pulley at the engaged portion.

6. A recoil starter according to claim 1, wherein at least one notch is formed on the periphery of said pulley; said notch is a combination of a rectangle and a right triangle; and said rectangle is positioned so as to precede in the rotating direction of said pulley.

7. A recoil starter according to claim 1, wherein said starter case and reel are made of resin and wherein said arm means is made of metal or resin.

* * * * *